United States Patent [19]

Hojberg

[11] 4,381,726

[45] May 3, 1983

[54] APPARATUS FOR APPLYING STRIPE MATERIAL TO A SOLID SURFACE

[75] Inventor: Svend Hojberg, Vejen, Denmark

[73] Assignee: A/S Phonix Tagpap OG Vejmaterialer, Vejen, Denmark

[21] Appl. No.: 322,293

[22] Filed: Nov. 17, 1981

[51] Int. Cl.[3] ..... B05C 5/02

[52] U.S. Cl. ..... 118/315; 118/305; 118/323; 118/313; 118/DIG. 4; 427/137; 427/286; 427/420

[58] Field of Search ..... 427/137, 286, 420; 118/305, 315, 323, DIG. 4, 313; 222/559, 561, 504; 425/145, 464

[56] References Cited

U.S. PATENT DOCUMENTS

| | | | |
|---|---|---|---|
| 2,723,782 | 11/1955 | Dwyer | 222/504 X |
| 3,242,003 | 3/1966 | Brown | 118/DIG. 4 |
| 3,667,258 | 6/1972 | Newton | 118/315 |

FOREIGN PATENT DOCUMENTS

| | | | |
|---|---|---|---|
| 2118852 | 11/1971 | Fed. Rep. of Germany . | |
| 2135033 | 6/1973 | Fed. Rep. of Germany . | |
| 2160311 | 6/1973 | Fed. Rep. of Germany . | |
| 1051888 | 12/1966 | United Kingdom | 118/305 |
| 285021 | 12/1970 | U.S.S.R. | 118/315 |

*Primary Examiner*—Shrive P. Beck

*Attorney, Agent, or Firm*—Cushman, Darby & Cushman

[57] ABSTRACT

An apparatus for applying hot thermoplastic stripe material to a solid surface. The apparatus comprises a pipe circuit including various means for storing and circulating stripe material, an applying device for said material, as well as an electronic control unit controlling the applying device. The applying device comprises a plurality of adjoining controllable gates. Each gate opening is of a width, i.e. the dimension perpendicular to the paper of FIG. 1, corresponding to a width module in the multi-stripe complex to be applied, whereas the height of the gate opening corresponds to the thickness of the applied material. The total width of the gates corresponds at least to the total width of the multi-stripe complex to be applied. Fluid-operated actuating means are present on the applying device, which serve to open and close the gates quickly. In this manner a possibility of a simultaneous applying of several marking stripes in a multi-stripe complex is obtained. Furthermore, the width of each stripe is easy to change. In addition, it is ensured that the beginning and the ending of each stripe is clear cut.

8 Claims, 6 Drawing Figures

APPARATUS FOR APPLYING STRIPE MATERIAL TO A SOLID SURFACE

Figure 1:
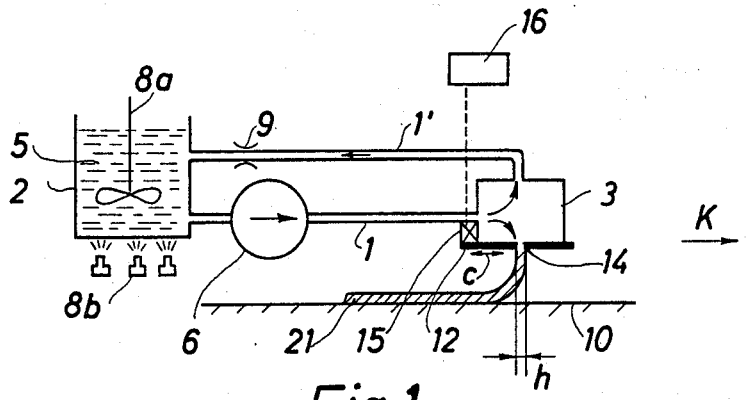

The invention relates to an apparatus for applying hot thermoplastic stripe material to a solid surface, said apparatus comprising a pipe circuit including a container for stripe material and provided with a heating and stirring unit, a pump and an applying device for said material, as well as an electronic control means controlling the applying device.

An apparatus of this type is known, whereby the applying device is an applying scoop operating according to the so-called "curtain"-system. A gear pump is built into the scoop and presses the stripe material out through a slot in the bottom of the scoop. However, such an apparatus requires a replacement of the entire applying scoop at change of stripe width and stripe complex (stripe pattern). In addition, the beginning and the ending of the stripe applied do not appear as clear cut as desired because the mechanism opening and closing the slot in the scoop is not adapted to momentary function.

The object of the invention is to provide an apparatus of the above type, which permits simultaneous applying of several marking stripes in a multi-stripe complex, and which furthermore permits an easy change of the width of each stripe, and finally which ensures that the beginning and the ending of the stripes appear clear cut.

The apparatus according to the invention is characterized in that the applying device comprises a plurality of adjoining controllable gates, whereby each gate opening is of a width, i.e. the dimension across the moving direction, corresponding to a width module of a multi-stripe complex to be applied, whereas the height, i.e. the dimension in the moving direction, of the gate opening corresponds to the thickness of the material applied, the total width of said gates at least corresponding to the total width of the multi-stripe complex to be applied to the surface, fluid-operated actuating means being provided on the applying device for a quick opening and closing of the gates. As a result, several gates permit a simultaneous applying of several stripes within the multi-stripe complex, and depending on the number of gates being opened, each stripe may be of a predetermined width corresponding to a predetermined number of said module. Furthermore, the beginning and the ending of the stripes are clear cut on account of the short closing and opening periods of the gates. The multi-stripe complex in question is for instance a marking of the middle of the road in three positions, a marking of the sides of the road and airport runaway markings of a width not exceeding for instance 50 cm.

According to the invention the gates may be located in parallel and built into a common box for distribution of stripe material. In this manner an easy control of the gates is obtained.

Furthermore according to the invention, the actuating means may comprise one or several, preferably pneumatic cylinders with pistons and piston rods as well as a rocking device connecting the piston rods and the gate plates of the gates, the piston rods adjacent their free ends comprising flange portions located at regular intervals and on each side of the rocking device in order to impact on the rocking device in such a manner that the gates may be opened and closed substantially instantaneously. As a result, the gate plates always initiate their movement with a great acceleration, since a flange portion does not impact on the rocking device until said flange portion has gathered substantial speed. Thus the flange portions impact heavily on the rocking device.

Moreover according to the invention, the rocking device connected to the piston rod of each cylinder may be adapted to move two or several gates simultaneously, whereby the apparatus is adjustable in a very simple manner to the very stripe width desired for each stripe in the multi-stripe complex. In addition, the beginning and the ending of each stripe, e.g. in a dotted stripe, appear clear cut.

According to the invention, the connection between the rocking device and the gate plate of each gate may be such that for a predetermined desired period it may be broken, e.g. by the gate plate comprising a rod provided with a terminal nut, which may co-operate with a groove in a rocker in the rocking device, a spring, preferably a spiral spring, being inserted between the gate plate and the rocker. When a gate is to be prevented from opening and closing, the nut is screwed so far outwards on the rod of the gate plate that the rocker cannot impact on it during its forward and backward rocking, said rocking movement deriving from the impact of the previously mentioned flange portions. The spring keeps the gate in question closed. This closing of the gate implies that the width of the stripe in question in the stripe complex is reduced by one module.

According to the invention, part of the pipe circuit and the box may be provided with a system of hot air ducts for heating the box and consequently the stripe material during the running of the apparatus, especially in the starting-up phase. In this manner the stripe material solidified in the pipe circuit and the box upon stopping of the apparatus for a long period, e.g. through the night, is relatively easily heated to a pumpable state. This is of great interest when starting up the apparatus. The hot air heating also compensates for the loss of heat of the box to the surroundings during the running of the apparatus.

Moreover according to the invention, the box may at one end and preferably adjacent the gates comprise a detachable cover giving access to the interior of the box. As a result, an easy cleaning of the box is obtained when layers of stripe material nevertheless should stick thereto.

In a preferred embodiment of the invention, the box may comprise an interior, substantially U-shaped channel for the stripe material, whereby one branch of the U opposes the portion in which the gate openings are formed, and the two channel branches may be connected to their respective channel in a supporting pipe suspended in the apparatus, said channels and said supporting pipe forming part of said pipe circuit.

Figure 2:
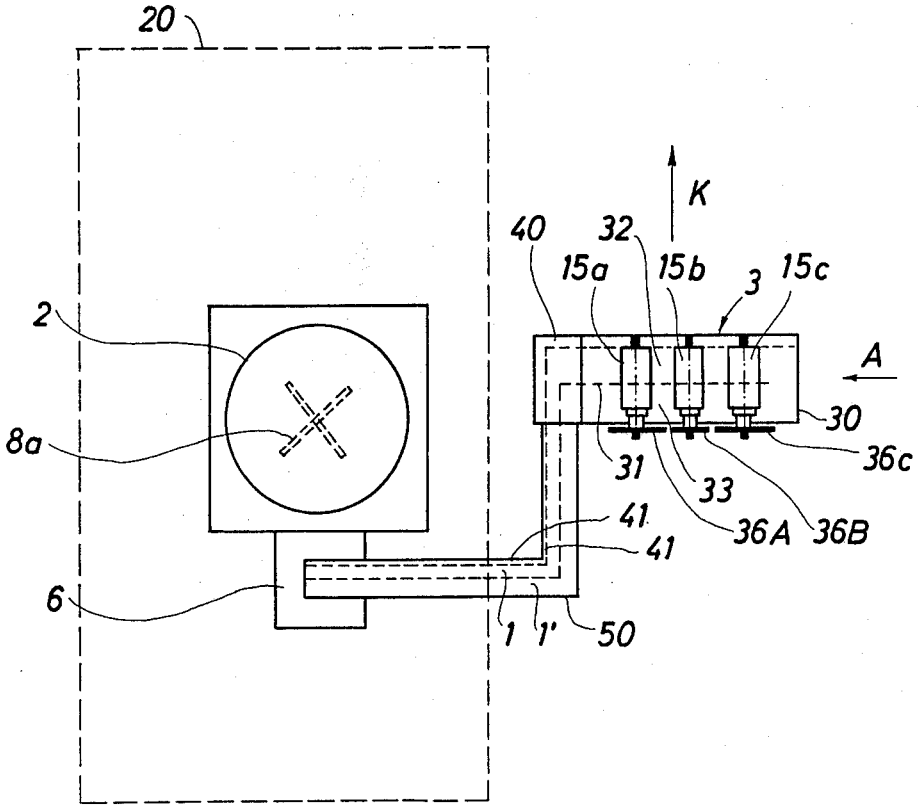
Figure 3:
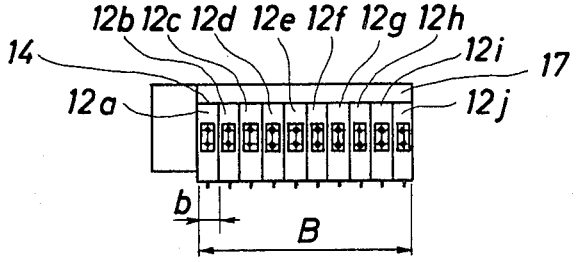
Figure 4:
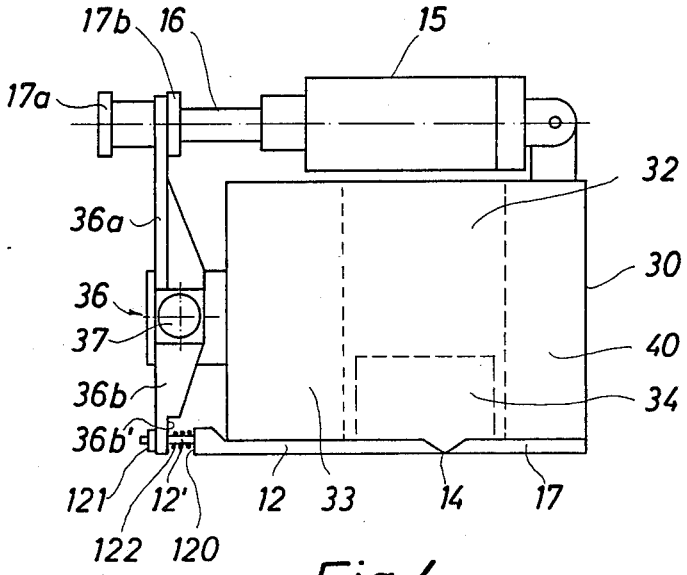
Figure 5:
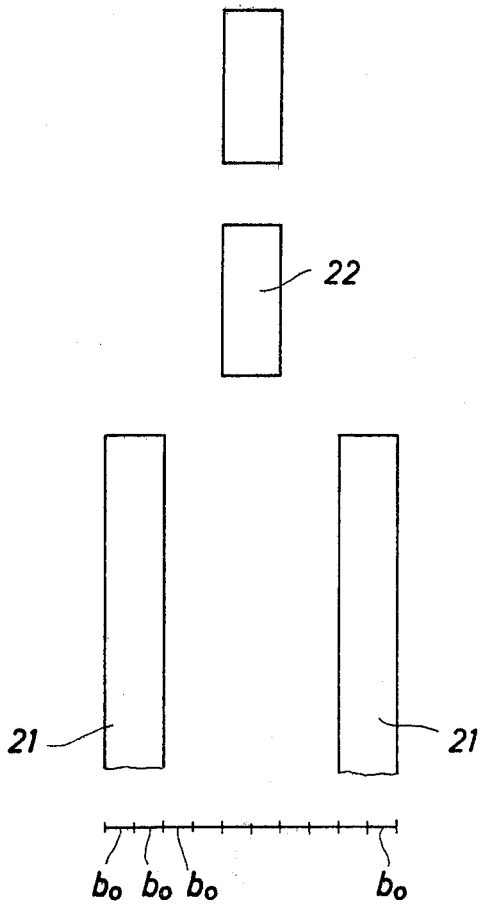
Figure 6:
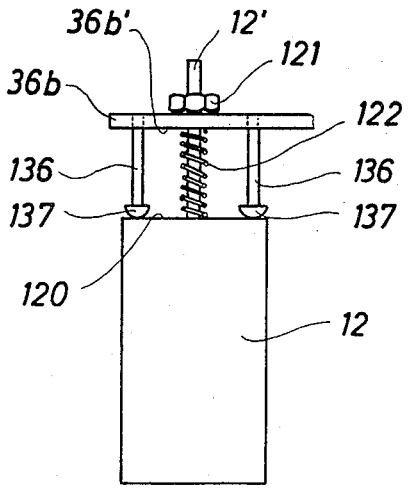

The invention will be described below with reference to the accompanying drawing, in which FIG. 1 is a diagrammatic side view of an embodiment of an apparatus according to the invention, FIG. 2 is a diagrammatic top view of the apparatus of FIG. 1, whereby the applying device with the associated supporting pipe clearly appears, FIG. 3 is a bottom view of the applying device of FIG. 2, FIG. 4 is a side view seen in the direction indicated by the arrow A in FIG. 2, of the applying device, FIG. 5 illustrates a multi-stripe complex in the form of a marking of the middle of the road applied by means of the apparatus according to the invention, and FIG. 6 is a bottom view of a gate plate as well as of part of the rocking device.

The apparatus illustrated in FIG. 1 is capable of moving on a solid surface 10, e.g. a roadway, and comprises a pipe circuit 1. This pipe circuit includes a container 2 for stripe material 5, an applying device 3 for applying liquid stripe material, and a pump 6 circulating the stripe material through the circuit. The container 2 is provided with a heating and stirring unit with burners 8*b* and a stirring propeller 8*a*. This unit keeps the thermoplastic stripe material sufficiently liquid so that it can be pumped through the circuit to the outermost corners of the applying unit 3. The latter is provided with a gate plate indicated at 12, but in fact several adjoining gate plates are present. In FIG. 1, only one gate plate appears which can be moved forward and backward in the directions indicated by the double arrow C in such a manner that a gate opening 14 can be opened and closed. The control of the gate plate 12 is effected by means of fluid-operated actuating means 15 in turn being controlled by an electronic control unit 16. The height of the gate plate, i.e. the dimension in the moving direction K, is indicated at h, which corresponds to the thickness of the marking stripe 21 being applied. A throttle valve is located at 9 for the adjustment of the flow of material through the pipe circuit. The apparatus is movable, but for the sake of clearness, the chassis, the wheels, and the coachwork have been omitted in FIG. 1.

The chassis and the coachwork appear at 20 in FIG. 2. The remaining reference numerals in FIG. 2 have the same meanings as in FIG. 1. FIG. 3 illustrates how the applying device comprises a plurality of juxtaposed gate plates, ten such plates 12*a*–12*j* appearing from this Figure. The gate plates may be made abutting or be removed from a transverse bar 17, for which reason the gate openings are formed at the line 14, i.e. at one edge of the bar 17. The gate opening of each gate is of a width b corresponding to a width module $b_o$ in the multi-stripe complex to be applied. The total width B of the multi-stripe complex to be applied cannot in the present case exceed $10 \times b$. FIG. 5 illustrates a marking of the middle of a road with three positions, i.e. three stripes 21, 22, whereby all the stripes are of the same width, and the transverse distance between the stripes corresponds to the width of the stripe. In the marking illustrated in FIG. 5, the gates 12*a*, 12*b*, 12*i*, 12*j* are open during the applying of the side stripes 21, whereas the gates 12*c*, 12*d*, 12*e*, 12*f*, 12*g*, and 12*h* are closed. When the dotted intermediary stripe 22 is applied, the gates 12*e* and 12*f* are opened and closed periodically, whereas the remaining gates remain closed.

As illustrated in FIG. 3 it is preferred to locate all the gates in parallel and to build them into a common box 30. It is of decisive importance for a sufficiently quick opening and closing of each gate that the actuating means 15 run sufficiently quickly. As illustrated in FIG. 2, these means comprise one or several fluid-operated cylinders, three cylinders being present in FIG. 2, viz. 15*a*, 15*b*, 15*c*, located on top of the box 30. Each cylinder 15 comprises a piston rod 16 and a rocking device 36, cf. FIG. 4, said rocking device also being secured on the box for connecting the piston rod to one or several gate plates 12. At its free end, each piston rod 16 comprises two flange portions 17*a* and 17*b* with a predetermined mutual distance and located on each side of a rocker 36*a* in the rocking device. The rocking device also comprises a rocker 36*b* in extension of the rocker 36*a*, and both rockers may rock about a shaft 37 secured on the box. The rocker 36*b* is connected to the gate plate 12 by the latter comprising a threaded rod 12′ projecting through a groove in the rocker 36*b*. This threaded rod furthermore comprises a terminal nut 121 adjustable in height at its outer end. A spiral spring 122 is inserted between one end surface 120 of the gate plate 12 and a side surface 36*b*′ on the rocker 36*b*. This spiral spring is located about the rod 12′. Furthermore, two adjustable thrust screws 136 are located on the side surface 36*b*′, cf. FIG. 6, the heads 137 of said thrust screws being rounded. These thrust screws abut the end surface 120 of the gate plate 12 when the gate in question functions, i.e. is not permanently closed. The thrust screws 136 are symmetrically located relative to the rod 12′ provided with a spring 122, cf. the Figure. The connection between the rocking device 36 and the gate plate 12 may, however, be provided in many other ways.

When the cylinder 15 is actuated for opening the gate plate 12, i.e. in such a manner that piston rods 16 are pulled inwards, a predetermined time lapses before the flange portion 17*a* impacts on the rocker 36*a*. This time delay implies that the rocker 36*a* is subjected to a heavy impact in such a manner that its starting acceleration is very great, whereby the starting acceleration of the rocker 36*b* and consequently of the gate plate are great too. Subsequently, when the cylinder 15 is to be actuated for closing the gate plate 12, the piston rod 16 is moved outwards, and after a predetermined period of time, the flange portion 17 impacts heavily on the rocker 36*a* whereby the starting acceleration of the rocker 36*a* and the rocker 36*b* is great. Since the rocker 36*b* with its two thrust screws now is turned to the right, the gate plate 12 is pressed by the thrust screws 136 and the spring 122 to the right in such a manner that the gate opening 14 is closed.

The rocking device 36 and consequently the rocker 36*b* can be common for several gates. When one of these gates must be closed permanently, its nut 121 is screwed so far to the left, cf. FIG. 4, that the left side of the rocker 36*b* during the forward and backward movements never abuts this nut. Now the rocker 36*b* only performs some movements, whereby it is constantly influenced by the thrust spring 122 keeping the gate plate pressed to the right, i.e. pressed into the box 30, whereby the gate opening 14 is kept closed.

Thus by actuating the cylinders 15 by means of compressed air from a compressor located on the chassis and pneumatic valves controlled by the electronic control unit 16, the gates are easily operated for opening and closing in such a manner that a predetermined combination of unbroken and dotted stripes in a stripe complex is obtained.

When the apparatus at the end of working hours is stopped and put aside, the stripe material present in the pipe circuit, i.e. also in the box 30, solidifies. In order to facilitate the starting up of the apparatus later on, the box 30, through which the stripe material may pass, is provided with a hot air duct 40 supplied with hot air through an auxiliary duct 41 in a supporting pipe 50 for the applying device 3. The hot air is supplied from the heating unit 8*b* of the container 2 through an injector not shown.

The box 30 comprises an interior longitudinal partition, cf. FIGS. 2 and 4, whereby the space passed by hot liquid stripe material is shaped as a substantially U-shaped channel. One branch 32 of the U is positioned just above the gate openings 14, whereas the other branch 33 of the U is located adjacent the rocking device 33, cf. FIG. 4. The free ends of the channel branches 32 and 33 are connected to the channels 1 and 1', respectively, in the supporting pipe 50, the hot stripe material being supplied from said channels and returned to the collecting container 2.

As illustrated in FIG. 4 the box 30 may at one end be provided with a detachable cover 34 permitting a relatively easy cleaning of the box in case deposits of stripe material nevertheless stick thereto.

In connection with FIG. 2, neither the compressor nor the compressed air pipe system with associated valves of the cylinders 15*a*–15*c*, nor the electronic control unit controlling said valves appear.

For marking the roads in Denmark, the width module $b_o$ is typically 50 mm. Ten gates imply that the largest stripe width which can be applied is 50 cm, which is of interest when striping airports and side lines on highways.

The invention may be varied in many ways without deviating from the scope of the invention. The actuating means 15*a*-15 may thus be hydraulically operated instead of pneumatically.

As illustrated in FIG. 2, the cylinders 15*a* and 15 may individually be connected to four gates through their respective rocking device 36A and 36C, and the cylinder 15*b* may be connected to two gates through a rocking device 36B.

The apparatus can apply all types of lines in a multi-stripe complex, e.g. center lines, side lines, warning lines, and pre-warning lines.

I claim:

1. An apparatus for applying hot thermoplastic stripe material to a solid surface as the apparatus is moved along the surface, said apparatus comprising a pipe circuit including a container for stripe material and provided with a heating and stirring unit, a pump and an applying device for said material, as well as an electronic control means controlling the applying device, characterized in that the applying device comprises a plurality of adjoining controllable gates, whereby each gate opening has a width dimension across the moving direction corresponding to a width module of a multi-stripe complex to be applied to the surface and a dimension in the moving direction corresponding to the thickness of the material applied, the total width dimensions of said gates at least corresponding to the total width of the multi-stripe complex to be applied to the surface, and fluid-operated actuating means on the applying device for quick opening and closing of the gates, said actuating means comprising at least one fluid-operated cylinder with a piston and piston rod as well as a rocking device connecting the piston rod and the gate plates of the gates, the piston rod adjacent its free end comprising flange portions located at regular intervals and on each side of the rocking device in order to impact on the rocking device in such a manner that the gates may be opened and closed substantially instantaneously.

2. An apparatus as claimed in claim 1, characterized in that the gates are located in parallel and built into a common box for distribution of stripe material.

3. An apparatus as claimed in claim 2, characterized in that part of the pipe circuit and the box are provided with a system of hot air ducts for heating the box and consequently the stripe material during the running of the apparatus.

4. An apparatus as claimed in claim 2 or 3, characterized in that the box at one end and adjacent the gates comprises a detachable cover giving access to the interior of the box.

5. An apparatus as claimed in claim 4, characterized in that the box comprises an interior, substantially U-shaped channel for the stripe material, whereby one branch of the U opposes the portion in which the gate openings are formed, and that the two channel branches are connected to their respective channel in a supporting pipe suspended in the apparatus, said channels and said supporting pipe forming part of said pipe circuit.

6. An apparatus as claimed in claim 1, characterized in that the rocking device connected to the piston rod is adapted to move a plurality of gates simultaneously.

7. An apparatus as claimed in claim 1, characterized in that the connection between the rocking device and the gate plate of each gate is such that for a predetermined desired period the connection may be broken.

8. Apparatus as in claim 7 wherein the gate plate includes a rod provided with a terminal nut, which co-operates with a groove in a rocker in the rocking device, a spiral spring being inserted between the gate plate and the rocker.

* * * * *